United States Patent [19]

Lehmann

[11] 4,285,218

[45] Aug. 25, 1981

[54] SYSTEM FOR FIXING PRINTS WITH REACTIVE AND VAT DYES

[75] Inventor: Helmut Lehmann, Buchholz, Fed. Rep. of Germany

[73] Assignee: Artos Dr.-Ing. Meier-Windhorst KG (GmbH), Seevetal, Fed. Rep. of Germany

[21] Appl. No.: 4,106

[22] Filed: Jan. 17, 1979

[30] Foreign Application Priority Data

Jan. 18, 1978 [DE] Fed. Rep. of Germany ..... 2802020

[51] Int. Cl.[3] ..... D06B 1/02; D06B 21/00

[52] U.S. Cl. ..... 68/5 D; 118/65; 118/634

[58] Field of Search ..... 118/64, 314, 65, 325, 118/634, 638, 326; 68/5 C, 5 D, 205 R; 134/159, 161

[56] References Cited

U.S. PATENT DOCUMENTS

| | | | |
|---|---|---|---|
| 2,129,249 | 9/1938 | Trahey | 118/65 |
| 2,245,301 | 6/1941 | Schacht | 118/638 X |
| 2,261,445 | 11/1941 | Olsen | 118/65 |
| 2,319,353 | 5/1943 | Schwartz et al. | 118/314 X |
| 2,762,331 | 9/1965 | Henderson | 118/634 |
| 3,222,895 | 12/1965 | Sheppard | 118/65 X |
| 3,421,701 | 1/1969 | Walters | 118/317 X |
| 4,084,412 | 4/1978 | Levielle | 68/5 C |

*Primary Examiner*—John P. McIntosh

*Attorney, Agent, or Firm*—Allison C. Collard; Thomas M. Galgano

[57] ABSTRACT

A system for the fixing of prints with reactive and vat dyes in the two phase printing method on textiles made of cellulose and, in particular, continuously running webs of material made of textile, knitted material, fleece, and the like, wherein the required auxiliary means for fixing is applied onto the web of material by electrostatic spraying. The system is characterized by the provision of a device for the electrostatic spraying of the auxiliary means onto the web of material which is positioned in the fixing device.

3 Claims, 2 Drawing Figures

SYSTEM FOR FIXING PRINTS WITH REACTIVE AND VAT DYES

Figure 1:
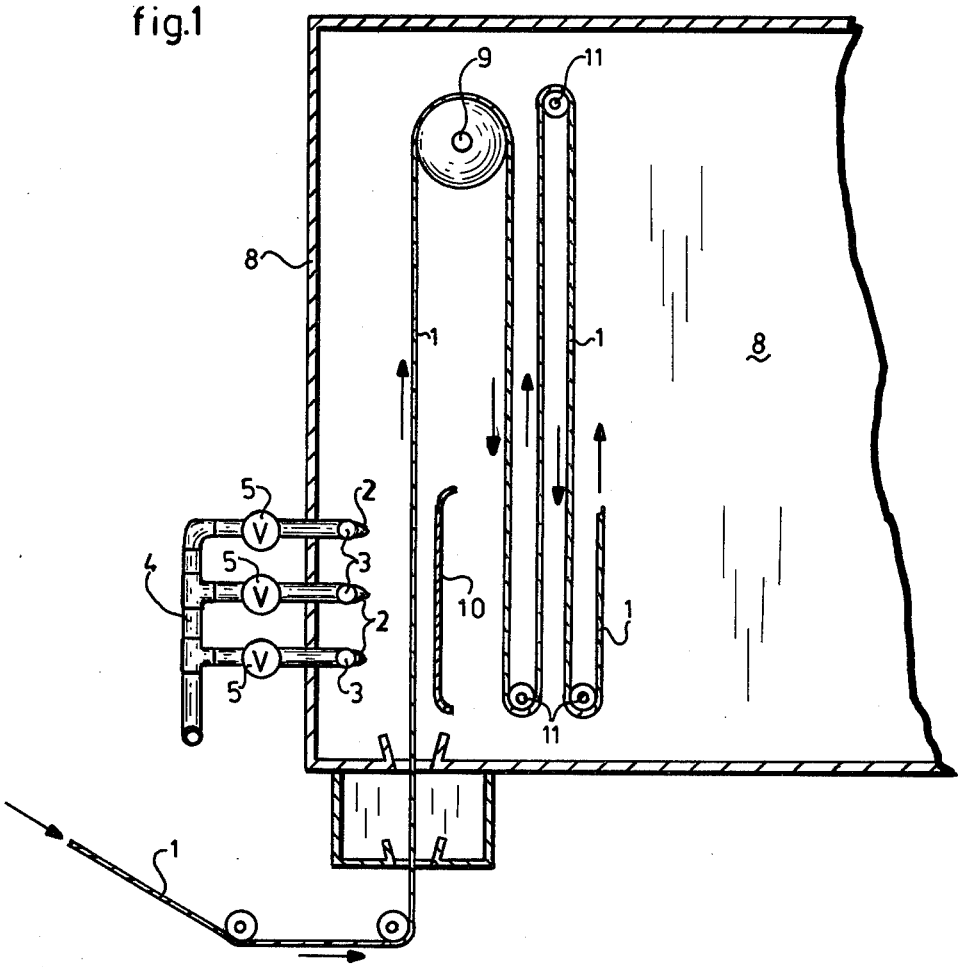

The invention relates to a system for the fixing of prints with reactive dyes and vat or regular dyes in the two phase printing method on textiles made of cellulose. In particular, it relates to such a method which is suitable for use in connection with continuously running webs of material made of textiles, knitted materials, fleece, or the like, wherein auxiliary means for fixing is applied onto the web of material by electrostatic spraying.

When fixing prints with reactive or vat dyes in the two phase printing method, the printed and dried textile material is uniformly wetted with the mixture containing the required chemicals and auxiliary means for fixing and is subsequently fed through a steamer wherein the printed dye penetrates into the fiber and is fixed thereon. The uniform wetting of the printed material is generally done by padding or foularding. Thereby, the material absorbs between 50% and 100% liquid in the foulard, depending on the raw material, volume, wettability, print cover and squeezing pressure.

In order to prevent an outflowing of the print with these relatively high liquid quantities, print thickeners are used which are brought to coagulation by the chemicals which are present in the chemical solution (alkali, borax, aluminum sulfate, or others) so as to retain the incorporated dye particles.

The gel which is formed is more or less sensitive to mechanical stress, depending on the compound. It is particularly sensitive to such stress when the wetted material is heated to a boiling temperature in the steamer, as a result of which the liquid content is further increased.

For this reason, roller engagement on the printed material is eliminated in the steamer in order to protect the printed material from spotting. However, with rather thin material and deep penetration printing of the material, a spotting caused by the rollers on the other side of the material is not always avoidable.

A further possible way to eliminate spotting is to have a light overheating of the steam to 110° to 120° C. which results in a surface drying of the material.

Furthermore, it is also possible to reduce the liquid absorption by means of a high squeezing pressure during foularding or a one-sided padding, so as to obtain a lower moisture content in the steamer together with a lower condensation wetting of the material.

However, the aforementioned means do not afford an absolute assurance against spotting, for example, when the web is passed about the rollers in a suspended loop steamer, or the like. Furthermore, there are limits in the fixing method on prints of light material and material which has a low absorption capability, as well as when high printing pressures are applied.

The aforementioned limitations can be eliminated by limiting the moisture content of the material to be steamed to about 10 to 35%. The lower moisture quantity also ensures the maintenance of print clarity.

In order to overcome the above difficulties when fixing the dyes in the two phase method it was previously suggested to apply chemical solutions onto the material which are printed with reactive or vat dyes by means of electrostatic spraying. Thereafter, it is possible to precipitate liquid quantities of up to a maximum of 50% with respect to the dry weight of the material by spraying the chemical solutions and the generated fog by means of an electrostatic field of 30 to 150 kV. The dissolved chemicals are sufficient to fix the print in the subsequent steaming process and to prevent an outflow of the print due to the lower moisture quantity. Even an engagement by the rollers on the printed side of the material does not cause smudging of the print. However, the technical resources which have to be applied when operating in a high voltage field, so as to protect the spray nozzles, are extremely high.

It is therefore an object of the subject invention to reduce the high costs heretofore required in the method of the electrostatic spraying of chemical auxiliary means onto textiles which are subsequently subjected to a fixing process, and at the same time obtain a better directing of the auxiliary means onto the web of material.

This object of the invention is obtained in accordance with the invention in a system of the aforementioned type wherein the device for the electrostatic spraying of the auxiliary means onto the web of material is mounted in the fixing means. Essentially, the device for spraying the auxiliary means onto the web of material is positioned in the heating path of the fixing device. Such an arrangement eliminates a separate suctioning off of the excess liquid quantity which does not reach the material anyway despite the electrostatic field. The effectiveness of the electrostatic field is the same within the steamer as it is outside of the steamer, e.g., one does not expect an impairment of the spray due to a short circuit or any other voltage variation, since the precipitating condensate which may precipitate in the area of the spray path is non-conductive.

Advantageously, the spray device may be provided with adjacent spray nozzles which are mounted on a bar which is positioned laterally with respect to the feeding direction of the web of material. It is recommended for an even or uniform distribution over the width of the web of material to use spray nozzles which can be selectively switched on or off in a lateral direction depending on the different widths of the web of material. Since the prepressure adjustment range of the spray nozzles is relatively small, it is recommended to dosage the liquid, with respect to the quantity rate of flow through the web of material, by mounting a plurality of consecutively arranged nozzle support bars which can be switched on and off, as desired. The liquid quantity can be up to a maximum of 50% with respect to the dry weight of the material. Preferably, it should be in a range of about 10% to 25%. If a complete dye yield is to be obtained, a vacuum steamer is used so that the spraying of the liquid must be carried out by means of hydraulic pressure.

The described device also permits one to increase the moisture quantity of the printed web of material in the one-phase method, for example, etch printing of textiles made of cellulose. As is very well known, the dye yield and the etch effects are influenced considerably by the moisture content.

Other objects and features of the present invention will become apparent from the following detailed description when taken in connection with the accompanying drawing which discloses one embodiment of the invention. It is to be understood that the drawing is designed for the purpose of illustration only, and is not intended as a definition of the limits and scope of the invention.

Figure 2:
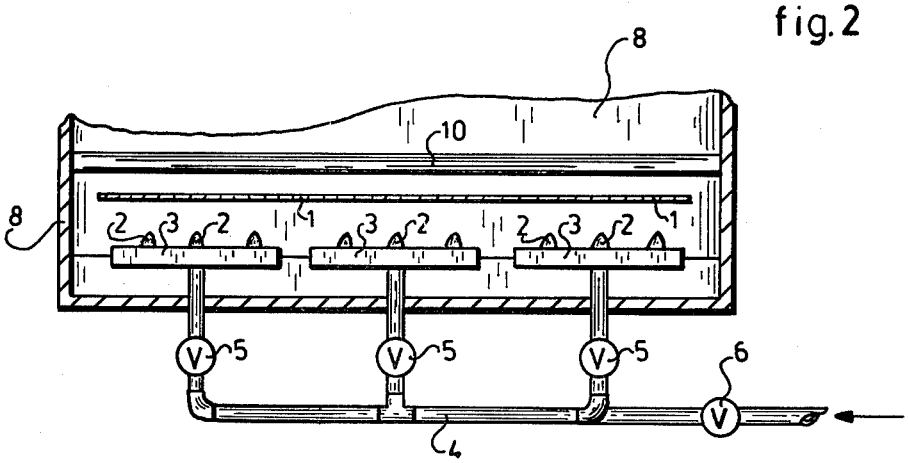

In the drawing, wherein similar reference characters denote similar elements throughout the several views:

FIG. 1 is a schematically-illustrated side view of a feeding portion of a steamer; and FIG. 2 is a schematically-illustrated plan view of the feeding portion of the steamer shown in FIG. 1.

As can be seen from FIGS. 1 and 2, a web of material 1 runs through a feed opening into a steamer housing 8 and is further fed through the housing over a return roller 9 and a multiplicity of further return rollers 11. At the feed opening, spray nozzles 2 are mounted on nozzle supports or bars 3 which are coupled with a supply vat and a transformer by means of segment valves 5 and support bar valves 6. Opposite of spray nozzles 2, one or a plurality of counter electrodes 10 are mounted. The web of material 1 is fed between the spray nozzles 2 which simultaneously act as electrodes and the counter electrodes 10.

Due to the mounting of the device for electrostatic spraying of the auxiliary means onto the web of material at the feed opening of the fixing device, the technical expense is considerably reduced with respect to electrostatic devices of the known type which are mounted outside of the fixing means. The deivice is also considerably simplified since no special screens are required to shield the spray nozzles and the surrounding area.

While only one embodiment of the present invention has been shown and described, it will be obvious to those persons of ordinary skill in the art, that many changes and modifications may be made thereunto without departing from the spirit and scope of the invention.

What is claimed is:

1. A system for the fixing of prints with reactive and vat dyes in the two-phase printing method on textile webs made of cellulose of the type wherein required auxiliary means for fixing is applied onto the textile web by electrostatic spraying, the improvement comprising:

a fixing device having a steamer housing which serves as a heating means;

means for moving a web through said steamer housing; and a spraying device for electrostatically spraying said auxiliary means onto the textile web which is positioned within said steamer housing of said fixing device, said spraying device comprising a plurality of spray nozzles, said nozzles serving as electrodes and each including valve means for effecting their activation and deactivation and at least one counter electrode mounted adjacent to said web, on the other side thereof and opposite to said spray nozzles, and a plurality of spray nozzle supports on which said spray nozzles are supported and which are disposed adjacent to said web on one side thereof in a transverse direction relative to the feeding direction of said web, and which supports are also disposed adjacent to each other and are spaced-apart in a longitudinal direction relative to said feeding direction.

2. The system according to claim 1, wherein said spray nozzles are air-free spray nozzles.

3. The system according to claim 2, wherein said air-free spray nozzles are actuated by hydraulic pressure.

* * * * *